US006129389A

United States Patent [19]

Younger

[11] Patent Number: 6,129,389

[45] Date of Patent: Oct. 10, 2000

[54] SELF MAILER WITH RETURN ENVELOPE FORMED FROM A SINGLE CUT SHEET

[75] Inventor: Zo Younger, Barrington, Ill.

[73] Assignee: The Standard Register Company, Dayton, Ohio

[21] Appl. No.: 08/152,741

[22] Filed: Nov. 15, 1993

Related U.S. Application Data

[62] Division of application No. 08/875,434, Apr. 29, 1992, Pat. No. 5,290,225.

[51] Int. Cl.[7] ..... B42D 15/00

[52] U.S. Cl. ..... 283/116; 229/92.3; 229/304; 229/307; 493/188; 493/267

[58] Field of Search ..... 283/116; 229/304, 229/92.1, 92.3, 92.4, 301, 307, 313, 316; 493/188, 264, 267, 921, 923

[56] References Cited

U.S. PATENT DOCUMENTS

| | | | |
|---|---|---|---|
| 4,487,360 | 12/1984 | Fisher et al. | 229/92.7 X |
| 4,668,211 | 5/1987 | Lubotta et al. | 493/188 |
| 4,715,531 | 12/1987 | Stewart et al. | 229/92.1 X |
| 4,896,823 | 1/1990 | Taylor | 229/92.3 X |
| 4,915,287 | 4/1990 | Volk et al. | 229/70 |
| 5,289,972 | 3/1994 | Sauerwine et al. | 229/92.1 X |

*Primary Examiner*—A. L. Wellington
*Assistant Examiner*—Monica Carter
*Attorney, Agent, or Firm*—Killworth, Gottman, Hagan & Schaeff, L.L.P.

[57] ABSTRACT

A single sheet business form construction printable in an impact or a non-impact printer includes a base sheet of face stock having a front, a back, a top, a bottom, and first and second sides. The base sheet is adapted to receive a first line of weakening in a first desired location extending adjacent and parallel to the first side to define a first tear strip on the base sheet between the first desired location and the first side. The base sheet is adapted to receive a second line of weakening in a second desired location extending adjacent and parallel to the second side to define a second tear strip on the base sheet between the second desired location and the second side. A first transverse line of weakening is intermediate and parallel the top and the bottom and extends between the first and second desired locations. A lateral strip of adhesive is parallel to the first transverse line of weakening between the transverse line of weakening and the bottom. When folded, a mailer with an internal return envelope results.

18 Claims, 7 Drawing Sheets

FIG. 4
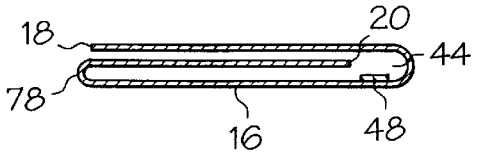
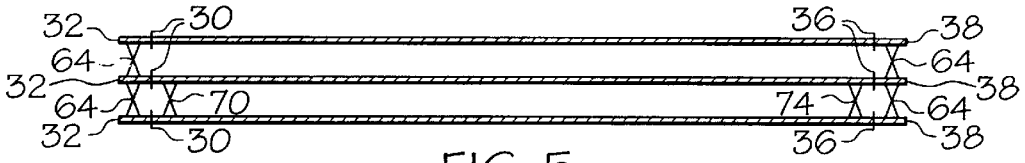
FIG. 5
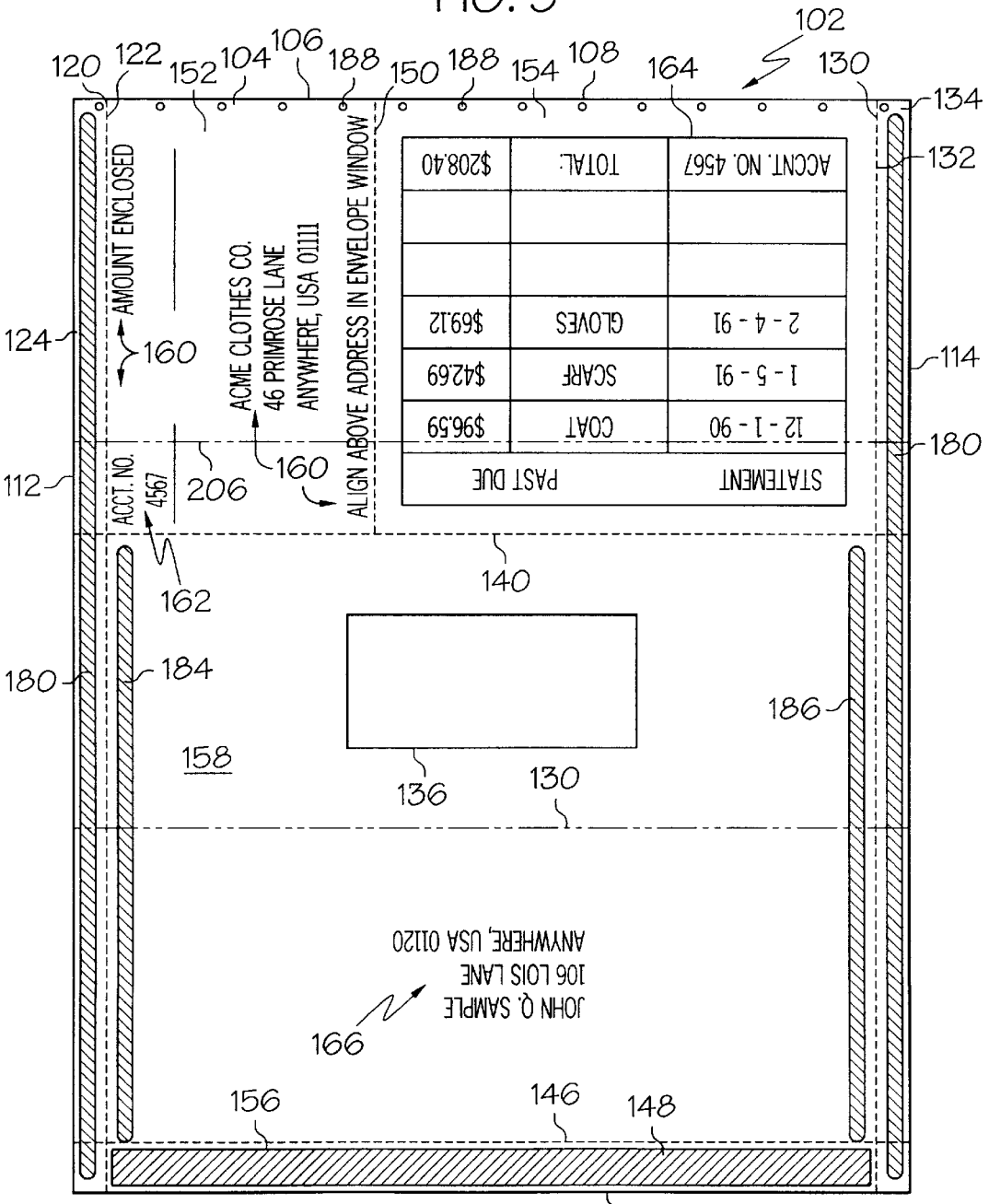
FIG. 6

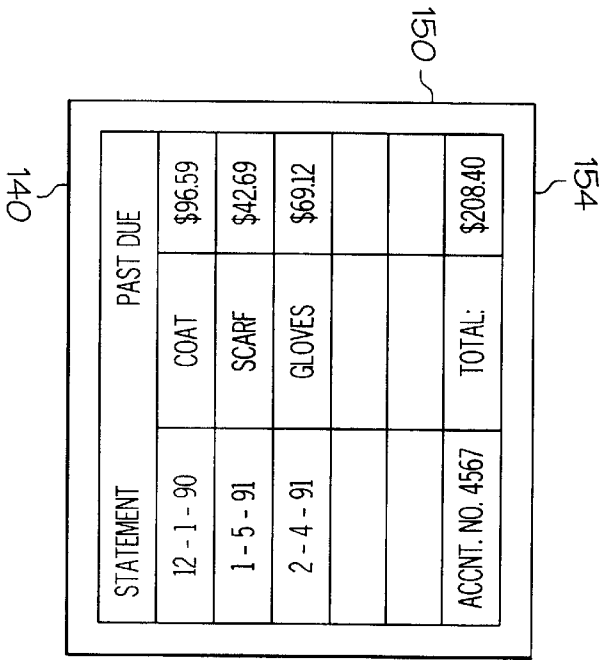
FIG. 10
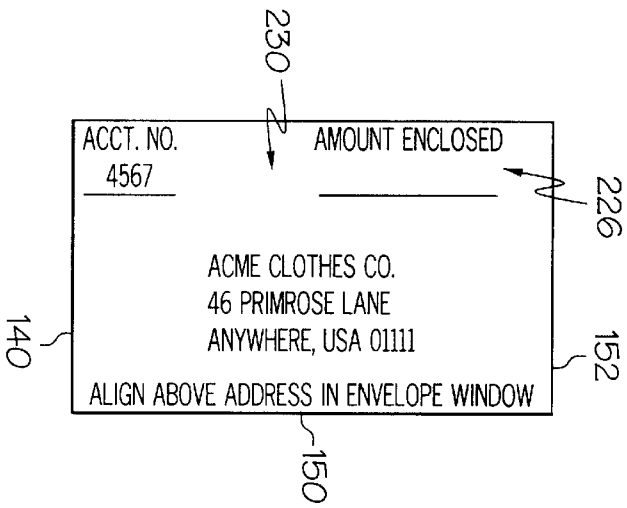
FIG. 11
FIG. 12
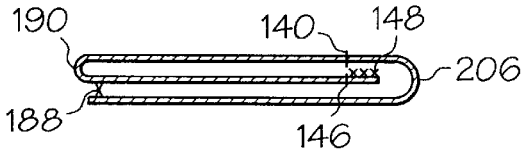
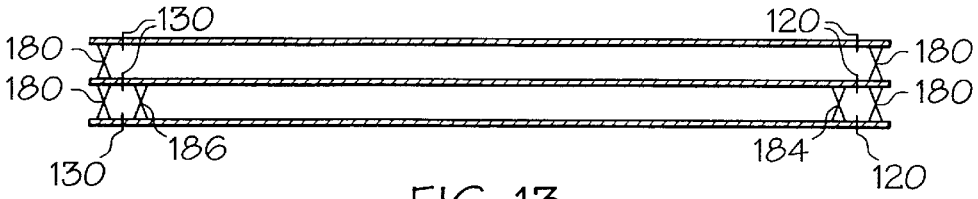
FIG. 13

SELF MAILER WITH RETURN ENVELOPE FORMED FROM A SINGLE CUT SHEET

This is a division of application Ser. No. 08/875,434 filed Apr. 29, 1992 U.S. Pat. No. 5,290,225.

FIELD OF THE INVENTION

This invention relates to business form constructions and, more particularly, to a self mailer printable in an impact or a non-impact printer, formed from a single cut sheet and including a return envelope.

BACKAROUND OF THE INVENTION

A large number of business form constructions are so called "mailers". Mailers are used for a variety of purposes, ranging from conveying promotional items or materials to the intended recipient to providing variable information such as bills or invoices, academic grades, etc. to the addressee. In many of these types of usages, the original recipient or addressee may be called upon to return something to the person or organization making the original mailing. For example, in the case of promotional mailings, a response to the promotion is frequently sought from the recipient. In the cases of bills or invoices, payment of the invoice or billed amount is expected by return mail.

To meet the need for response to mailings, many mailers include a return mailer or envelope. The intended recipient opens the original mailing, completes a form, makes out a check, or the like, and places the form or check in a return envelope included as part of the original mailer. The return envelope is then deposited in the mail.

For the most part, mailers heretofore have been so called "continuous business forms" which is to say that they are a series of mailers formed of superimposed plies with individual form lengths defined by transverse lines of weakening extending across the plies. Typically, the mailing is processed in continuous form and then the individual form lengths are separated on the lines of weakening and deposited in the mail. Recently, however, so called "cut sheet" business forms have been increasingly employed in mailers. In a cut sheet mailer, the mailers are processed as individual sheets that have already been cut from a web or the like. That is to say, cut sheet business forms are just the opposite of continuous business forms in that they have been severed into individual form lengths prior to their processing.

In the case of current cut sheet return mailers, they typically include a cut sheet with a tipped or glued on "backer panel" which creates a return envelope pocket for the mailer. The addition of this backer panel to the cut sheet effectively doubles the thickness of the mailer because it is made up of two sheets paper, rather than one. This factor has limited the use of such mailers because two sheet or two ply thickness mailers are not easily fed, if they can be fed at all, through many non-impact printers now on the market because many such non-impact printers are specifically designed to feed but a single sheet of paper at a time.

As a consequence, the advantages of cut sheet mailers cannot be realized by owners of many non-impact printers or, if such non-impact printer owners attempt to utilize cut sheet mailers, substantial feeding and jamming problems typically result.

The present invention is directed to overcoming one or more of the above problems.

SUMMARY OF THE INVENTION

It is a principal object of the invention to provide a new and improved cut sheet mailer. More specifically, it is an object of the invention to provide such a mailer that is ideally suited for use with non-impact printers in which may be processed therein without jamming.

One embodiment of the invention achieves the foregoing object in a single sheet business form construction printable in an impact or a non-impact printer. The business form includes a base sheet of face stock having a front, a back, a top, a bottom, and first and second sides. The base sheet is adapted to receive a first line of weakening in a first desired location extending adjacent and parallel to the first side to define a first tear strip on the base sheet between the first desired location and the first side. The base sheet is adapted to receive a second line of weakening in a second desired location extending adjacent and parallel to the second side to define a second tear strip on the base sheet between the second desired location and the second side. A first transverse line of weakening is intermediate and parallel the top and the bottom and extends between the first and second desired locations. A lateral strip of adhesive is parallel to the transverse line of weakening between the transverse line of weakening and the bottom.

Further features of the invention include adhesive applied to the first and second tear strips. In one embodiment, the first, second, and first transverse lines of weakening are perforation lines.

Still further features of the invention include the lateral strips of adhesive applied adjacent the first transverse line of weakening. In one embodiment, the lateral strip of adhesive can be remoistenable glue.

Still further features of the invention include a second transverse line of weakening parallel to the first transverse line of weakening and located between the first transverse line of weakening and the bottom to define an envelope flap. The lateral strip of adhesive is applied to the envelope flap. A third line of weakening is located between and parallel to the first and second desired locations and extends between the top and the first transverse line of weakening. A rectangular die cut defines an envelope window between the first and second transverse lines of weakening.

Another facet of the invention contemplates a business form including a return envelope and printable in an impact or a non-impact printer and having a base sheet of face stock as mentioned previously. The base sheet is adapted to receive a first line of weakening in a first desired location extending adjacent and parallel to the first side to define a first tear strip on the base sheet between the first desired location and the first side. The first tear strip has adhesive applied thereto. The base sheet is adapted to receive a second line of weakening in a second desired location extending adjacent and parallel to the second side to define a second tear strip on the base sheet between the second desired location and the second side. The second tear strip has adhesive applied thereto.

A first transverse line of weakening is intermediate and parallel the top and the bottom and extends between the first and second desired locations. A lateral strip of adhesive is adjacent and parallel to the first transverse line of weakening between the first transverse line of weakening and the bottom. A first thin strip of adhesive is located between the bottom and a lower edge of a lateral strip of adhesive and lies adjacent and parallel to the first desired location between the first and second desired locations. A second thin strip of adhesive is located between the bottom and the lower edge of the lateral strip of adhesive and lies adjacent and parallel to the second desired location between the first and second desired locations. The base sheet is folded along a base fold line and secured by the first and second thin strips of adhesive and to define an envelope pocket. The base fold line is located between the lower edge of the lateral strip of adhesive and the bottom.

Preferably, the base fold line is located about halfway between the lower edge of the lateral strip of adhesive and the bottom.

In a highly preferred embodiment of the invention, the distance between the top of the base sheet and the bottom of the base sheet is about 11 inches and the distance between the first and second side is about 8.5 inches. The distance between the top and the transverse line of weakening is about 3.5 inches and the distance between the lower edge of the lateral strip of adhesive and the bottom is about 7 inches.

In another facet of the invention, the base sheet includes the first and second lines of weakening, and the first transverse line of weakening as mentioned previously. The base sheet includes a second transverse line of weakening located adjacent and parallel the bottom and extending between the first and second desired locations to define an envelope flap between the second transverse line of weakening and the bottom. A third line of weakening is parallel to the first and second desired locations and extends between the top and the first transverse line of weakening. A lateral strip of adhesive is located adjacent and parallel to the second transverse line of weakening between the second transverse line of weakening and the bottom. A first thin strip of adhesive is located between the first and second transverse lines of weakening and lies adjacent and parallel to the first desired location between the first and second desired locations. A second thin strip of adhesive is located between the first and second transverse lines of weakening and lies adjacent and parallel to the second desired location between the first and second desired locations. The base sheet is folded along the base fold line and secured by the first and second thin strips of adhesive and the adhesive on the first and second tear strips to define an envelope pocket. The base fold line is located between the first and second transverse lines of weakening.

In a preferred embodiment, the base sheet includes a rectangular envelope window located between the first transverse line of weakening and the base fold line.

The invention also contemplates the method of making a business form construction printable in an impact or a non-impact printer. The method includes the steps of:

a) providing a base sheet of face stock having a front, a back, a top, a bottom, and first and second sides;

b) placing a first line of weakening adjacent and parallel to the first side of the base sheet to define a first tear strip on the front of the base sheet between the first line of weakening and the first side;

c) placing a second line of weakening adjacent and parallel to the second side to define a second tear strip on the front of the base sheet between the second line of weakening and the second side;

d) placing a first transverse line of weakening extending between the first and second line of weakening;

e) locating a lateral strip of adhesive between the first transverse line of weakening and the bottom;

f) applying adhesive to the first and second tear strips, and applying first and second thin strips of adhesive just inwardly of the first and second lines of weakening, respectively, between the first transverse line of weakening and the bottom;

g) folding the base sheet along a base fold line to define an envelope pocket, said base fold line being located between the first transverse line of weakening and the bottom; and h) printing information on a portion of the front side between the top and the first transverse line of weakening.

In a preferred embodiment, the further step of:

i) folding the base sheet upon itself between the base fold line and the top to enclose the envelope pocket.

In a preferred embodiment, steps a), d), e) and h) are performed before step f), and steps g) and i) are performed after step f) and before step b) and c).

A preferred method of the invention includes the steps of:

j) placing a second transverse line of weakening parallel to and adjacent the bottom and extending between the first and second lines of weakening to define an envelope flap between the second transverse line of weakening and the bottom;

k) cutting a rectangular envelope window in the base sheet between the first transverse line of weakening and the base fold line;

l) placing a third line of weakening parallel to the first and second lines of weakening and extending between the top and the first transverse line of weakening; and, m) applying a plurality of glue dots across said top.

In a highly preferred embodiment of the invention, steps a), d), e), h), j) and l) are performed before steps f), k) and m), and steps g) and i) are performed after steps f), k) and m) and before steps b) and c). Other objects and advantages will become apparent from the following specification taken in connection with the accompanying drawings.

BRIEF DESCRIPTION OF THE DRAWINGS

FIG. 4 is a schematic sectional view taken approximately along the line 4—4 in FIG. 2;

FIG. 5 is a schematic sectional view taken approximately along the line 5—5 in FIG. 2;

FIG. 6 is a plan view of a front of an alternate embodiment of the business form construction prior to being folded and mailed;

FIG. 10 is a plan view of the customer records portion of the alternate business form construction;

FIG. 11 is a plan view of the returnable portion of the alternate business form construction;

FIG. 12 is a schematic sectional view taken approximately along line 12—12 in FIG. 8; and FIG. 13 is a schematic sectional view taken approximately along line 13—13 in FIG. 8.

DETAILED DESCRIPTION OF THE PREFERRED EMBODIMENT

Figure 1:
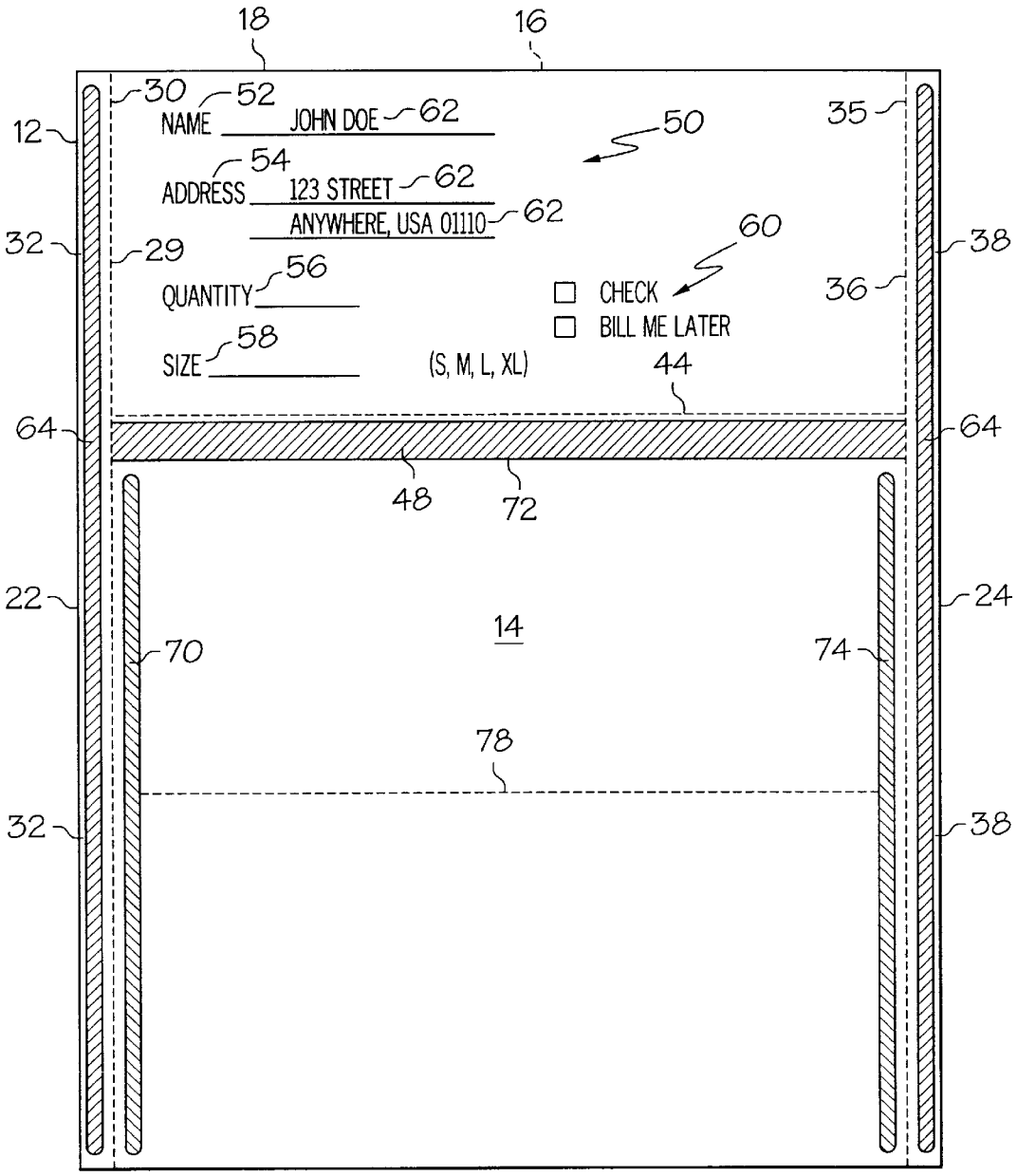
FIG. 1 is a plan view of one embodiment of the business form construction prior to being folded and mailed.

A single sheet business form construction made according to the invention and printable in an impact or a non-impact printer is shown in FIG. 1. The business form construction comprises a paper sheet 12 of suitable stock having a front 14, a back 16 (FIG. 2), a top 18, a bottom 20, a first side 22 and a second side 24 parallel to the first side 22. The distance between the top 18 and the bottom 20 can be about 11 inches and the distance between the first and second sides 22, 24 can be about 8.5 inches.

The base sheet 12 is adapted to receive a first line of weakening 29 in a first desired location (dotted line 30). When created, the first line of weakening 29 extends both adjacent and parallel the first side 22 to define a first tear strip 32 on the base sheet 12 between the first desired location 30 for the first line of weakening 29 and the first side 22. Typically, the tear strip will be about a ¼ to a ½ an inch wide. The base sheet 12 is adapted to receive a second line of weakening 35 in a second desired location (dotted line 36). When created, the second line of weakening extends adjacent and parallel to the second side 24 to define a second tear strip 38 (also about ¼ to ½ an inch wide) on the base sheet 12 between the second desired location 36 for the second line of weakening 35 and the second side 24.

Preferably, the first and second lines of weakening 29, 35 are not created until after the base sheet 12 is folded as described below. This is due to the fact that alignment problems can occur when the first and second lines of weakening 29, 35 are created before the base sheet 12 is folded since portions of the first and second lines of weakening may not be aligned after folding. When a customer attempts to remove the misaligned first and/or second tear strip 32, 38, the business form construction may be damaged.

A first transverse line of weakening 44 is intermediate and parallel to the top 18 and the bottom 20 and extends between the first line of weakening 29 and the second line of weakening 35. Note that while the first and second lines of weakening 29, 35 are created after the base sheet 12 is folded, the first transverse line of weakening 44 is initially placed between the first and second desired locations 30, 36 for the first and second lines of weakening 29, 35. The distance between the top 18 and the first transverse line of weakening 44 can be about 3.5 inches.

The first, second and first transverse lines of weakening 29, 35, 44, respectively, can be perforation lines.

A lateral strip of adhesive 48 lies immediately adjacent and parallel to the first transverse line of weakening 44 between the first transverse line of weakening 44 and the bottom 20. The lateral strip of adhesive 48 preferably is remoistenable glue.

The business form 10 can then be fed into an impact or a non-impact printer where printed information 50 can be printed on the front 14 between the transverse line of weakening 44 and the top 18. For example, the printed information 50 can include fixed information such as name indicia 52, address indicia 54, quantity indicia 56, size indicia 58 and payment indicia 60. Alternatively, the fixed information may be preprinted on the form before being sent to the user. Additionally, the non-impact printer can print variable information 62. Variable information is, of course, information that changes from one form to the next, as for example, the name and address of an intended recipient. The non-impact printer can also print fixed and/or variable information on the back 16 of the base sheet 12.

After the information 50, including specifically the variable information 62, is printed on the base sheet 12, strips of adhesive 64 are applied to the first and second tear strips 32, 38. At the same time, a first thin strip of adhesive 70 is applied between the bottom 20 and a lower edge 72 of the lateral strip of adhesive 48. The thin strip of adhesive 70 lies closely adjacent and parallel to the first line of weakening 29 between the first and second lines of weakening 29, 35 respectively. When the first line of weakening 29 is created after the base sheet 12 is folded, the first thin strip 70 is applied adjacent and parallel to the first desired location 30 for the first line of weakening 29 between the bottom 20 and the lower edge 72.

A second thin strip of adhesive 74 is simultaneously applied between the bottom 20 and the lower edge 72 of the lateral strip of adhesive 48. The distance between the lower edge 72 of the lateral strip of adhesive 48 can be about 7 inches. The second strip of adhesive 74 lies adjacent and parallel to the second line of weakening 35 between the first and second lines of weakening 29, 35, respectively. When the second line of weakening 35 is created after the base sheet 12 is folded, the second thin strip 74 is applied adjacent and parallel the second desired location 36 for the second line of weakening 35 between the bottom 20 and the lower edge 72. While the adhesive strips 64, 70, 74 are shown as continuous strips, those skilled in the art will recognize that the strip could be formed by a series of individual glue dots if desired.

Figure 1A:
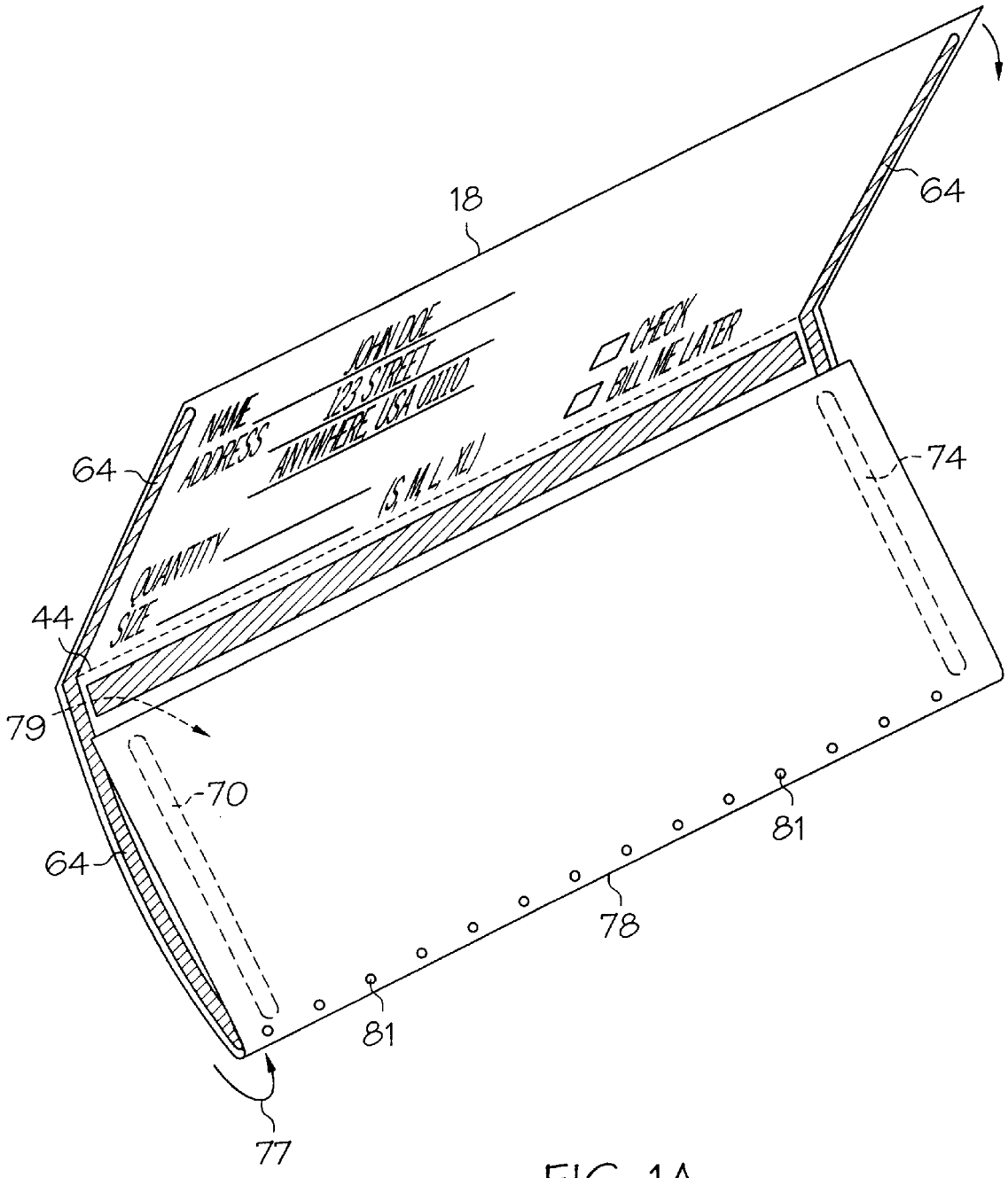
FIG. 1A is a perspective view of the business form construction being folded and adhered to itself.

The base sheet 12 is then folded along a base fold line 78 as shown at arrow 77 in FIG. 1A and secured by adhesive strips 64, 70, 74, to define a return envelope pocket 79. The base fold line 78 is located between the lower edge 72 of the lateral strip of adhesive 48 and the bottom 20.

The first and second thin strips of adhesive 70, 74, respectively do not need to extend continuously from the lower edge 72 of the lateral strip of adhesive 48 to the bottom. The first and second thin strips 70, 74, respectively, only need to be of a sufficient length to adequately secure the base sheet 12 below the base fold line 78 to the base sheet 12 above the base fold line 78 to form the return envelope pocket 79. For example, the first and second thin strips 70, 74, respectively, could extend between the lower edge 72 and the base fold line 78. Alternatively, the first and second thin strips of adhesive 70, 74, respectively, could extend between the base fold line 78 and the bottom 20. Other effective patterns of applying adhesive are readily apparent.

Preferably, the base fold line 78 is located about half way between the lower edge 72 and the bottom 20 so that the bottom 20 lies just below the lower edge 72 when the base sheet 12 is folded along the base fold line 78. Thus, the area occupied by the remoistenable adhesive 48 may service as a flap for the return envelope pocket 79 with the adhesive serving as a means to seal the same.

The base sheet 12 is then folded upon itself again between the base fold line 78 and the top 18 and adhered to itself at least by the adhesive 64 on the first and second tear strips 32, 38, respectively to enclose the envelope pocket 69. For example this fold may occur on the first transverse line of weakening 44 as shown in FIG. 1A. Horizontal glue dots 81 can be applied adjacent the base fold line 78. If the first and second lines of weakening 29, 35 were not previously made, the first line of weakening 29 is made along the first side 22 in the first desired location 30 and the second line of weakening 35 is made along the second side 24 in the second desired location 36.

Other sizes for the base sheet 12 are contemplated. For example, the distance between the top and the bottom could be about 14 inches. In such a case the distance between the first and second sides could be about 8.5 inches and the distance between the top and the transverse line of weakening could be about 4⅞ inches. The distance between the lower edge of the lateral strip could be about 8 inches.

Figure 2:
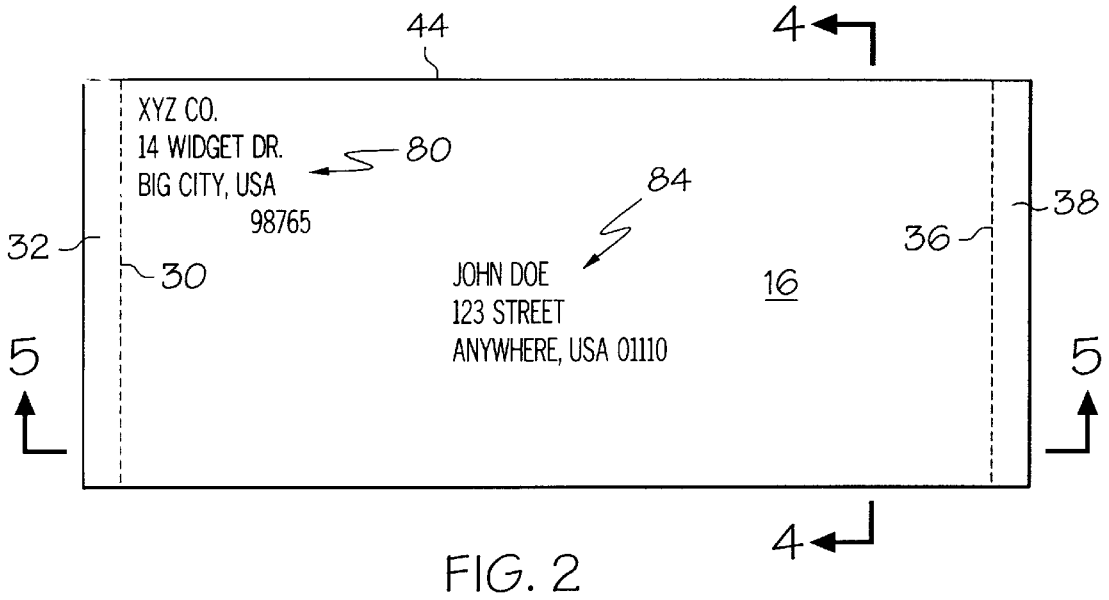
FIG. 2 is a plan view of the business form construction folded and ready to be mailed.
Figure 3:
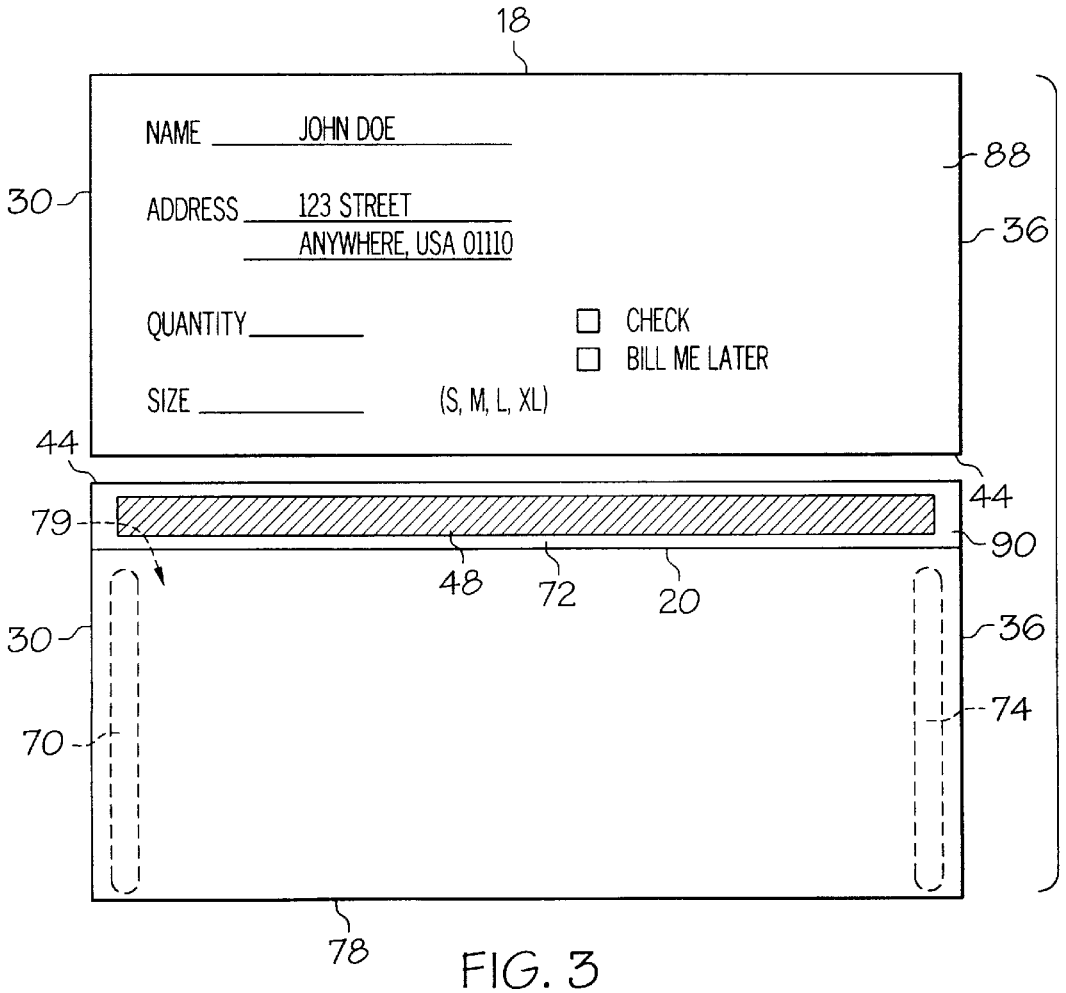
FIG. 3 is a plan view of the business form construction opened and with the removable top portion and the first and second tear strips removed.

FIG. 2 shows the business form construction 10 folded and ready to be sent to a customer. Fixed information 80 can be printed on the back 16 of the base sheet 12 when the printed information 50 is printed on the front 14 of the base sheet 12. Variable information 84 can also be printed at the same time. Alternatively, the fixed information 80 or the variable information 84 can be address labels, or hand printed. At this time the adhesive 64 in the tear strip 32, 38 has sealed the mailer, preventing inspection of the variable information 62 on the interior thereof.

When the customer receives the folded business form 10, the customer removes and discards the first and second tear strips 32, 38, respectively, by tearing along the first and second lines of weakening 29, 35, respectively and separating the top 18 from the horizontal glue dots 81. The mailer is then opened. The customer then removes a top portion 88 by tearing along the first transverse line of weakening 44. The customer can then fill in additional variable information, for example, the quantity indicia 56, the size indicia 58, and the payment indicia 60. A check may be enclosed if required. The customer then inserts the removable top portion 88 into the envelope pocket 79, moistens the lateral strip of adhesive 48 and folds an envelope flap 90 (located above the bottom 20 and below the first transverse line of weakening 44) down over the bottom 20 to enclose the envelope pocket.

Figure 7:
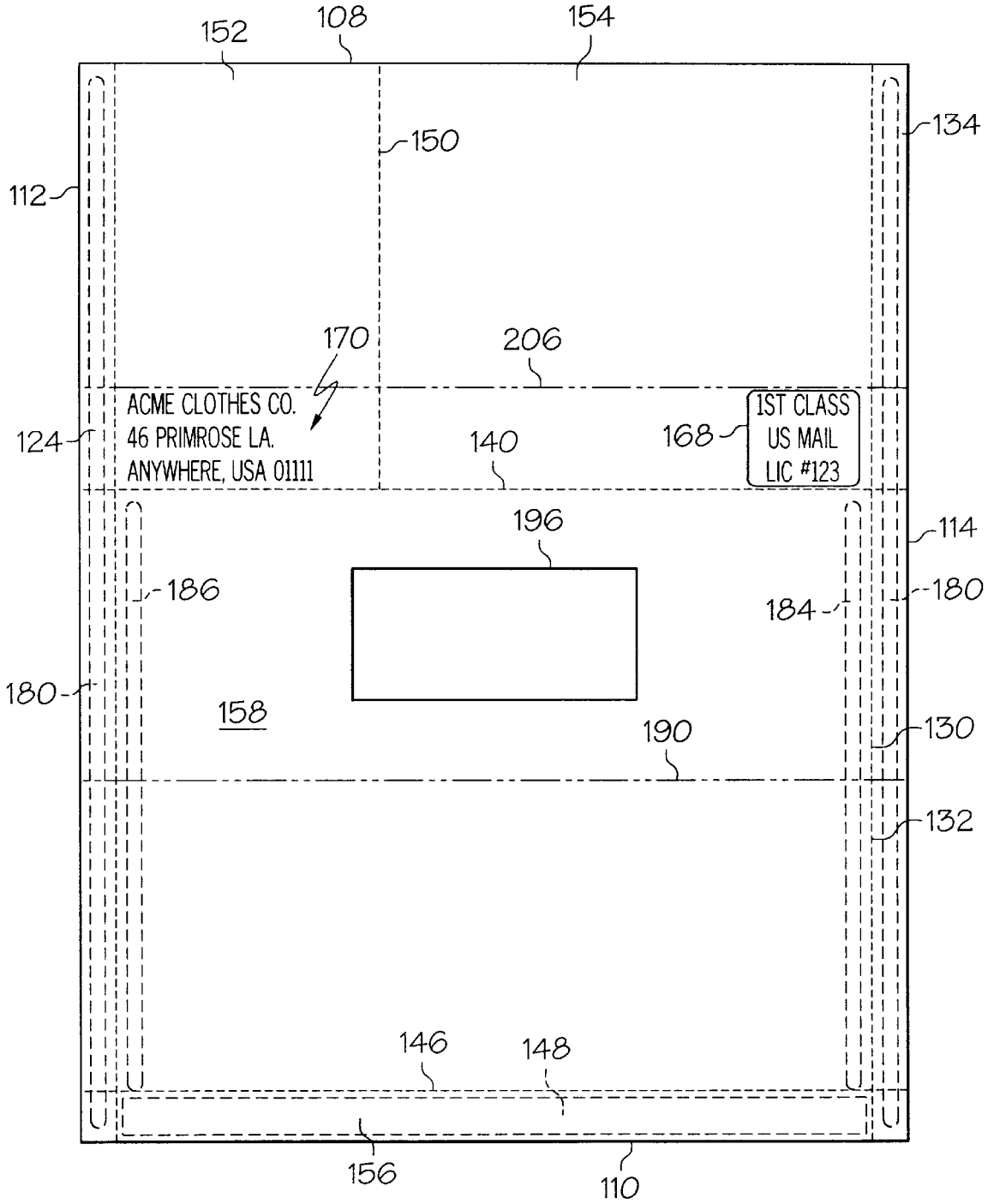
FIG. 7 is a plan view of a back of the alternate business form construction prior to being folded and mailed.

An alternate single sheet business form construction made according to the invention printable in an impact or non-impact printer is shown in FIG. 6. The business form construction comprises a base sheet 102 having a front 104, a back 106 (FIG. 7), a top 108, a bottom 110, a first side 112 and a second side 114 parallel to the first side 112.

The base sheet 102 is adapted to receive a first line of weakening 120 in a first desired location (dotted line 122). When created, the first line of weakening 120 extends both adjacent and parallel to the first side 112 to define a first tear strip 124 on the base sheet 102 between the first desired location 122 for the first line of weakening 120 and the first side 112. Typically, the tear strip will be about ¼ to ½ inch wide. The base sheet 102 is adapted to receive a second line of weakening 130 in a second desired location (dotted line 132). When created, the second line of weakening extends adjacent and parallel to the second side 114 to define a second tear strip 134 (also about ¼ to ½ inch wide) on the base sheet 102 between the second desired location 132 for the second line of weakening 130 and the second side 114.

Preferably, the first and second lines of weakening 120, 130 are not created until after the base sheet 102 is folded (as described below). Alignment problems similar to those described with respect to the base sheet 12 of FIG. 1 can occur.

A first transverse line of weakening 140 is intermediate and parallel to the top 108 and the bottom 110 and extends between the first line of weakening 120 and the second line of weakening 130. Note that while the first and second lines of weakening 120, 130 are created after the base sheet 102 is folded, the transverse line of weakening 140 is initially placed between the first and second desired locations 122, 132 for the first and second lines of weakening 120, 130, respectively. The first, second and first transverse lines of weakening 120, 130, 140, can be perforation lines.

A second transverse line of weakening 146 lies adjacent and parallel to the bottom 110 and extends between the first line of weakening 120 (or the first desired location 122) and the second line of weakening 130 (or the second desired location 134). A lateral strip of adhesive 148 lies between the second transverse line of weakening 146 and the bottom 110. The lateral strip of adhesive 148 preferably is remoistenable glue.

A third line of weakening 150 is parallel to the first line of weakening 120 (or the first desired location 122) and the second line of weakening 130 (or the second desired location) and extends between the top 108 and the first transverse line of weakening 140. A returnable portion 152 of the base sheet 102 is defined by the first line of weakening 120 (for the first desired location 122), the first transverse line of weakening 140, the third line of weakening 150, and the top 108. A customer records portion 154 of the base sheet 102 is defined by the top 108, the third line of weakening 150, the first transverse line of weakening 140, and the second line of weakening 130 (or second desired location 132).

An envelope flap 156 is defined by the second transverse line of weakening 146, the first line of weakening 120 (or first desired location 122), the second line of weakening 130 (or second desired location 132), and the bottom 110. A return envelope portion 158 is defined by the first transverse line of weakening 140, the second transverse line of weakening 146, the first line of weakening 120 (or first desired location 122), and the second line of weakening 130 (or second desired location 132).

The business form can be fed into an impact or a non-impact printer. The returnable portion 152 could include printed fixed information 160, such as return address indicia, instruction indicia, account number indicia, and amount indicia. The returnable portion 152 could also include variable information 162 such as the customer account number, etc. The customer records portion 154 could include both fixed and variable information at 164 such as customer status information or other information. The return envelope 158 could include variable information 166 such as a customer's address and/or fixed information (not shown). Fixed and variable information can also be printed on the back 106 of the base sheet 102.

For example, the fixed information could include a postage stamp 168 and a return address 170. Variable information on the back 106 is also contemplated.

After printing fixed and variable information on the base sheet 102, adhesive strips 180 are applied to the first and second tear strips 124, 134. At the same time, a first thin strip of adhesive 184 is applied between the first transverse line of weakening 140 and the second transverse line of weakening 146 adjacent the first line of weakening 120 (or first desired location 122). A second thin strip of adhesive 186 is simultaneously applied between the first transverse line of weakening 140 and the second transverse line of weakening 146 adjacent the second line of weakening 130 (or the second desired location 132).

While the adhesive strips 180, 184, 186, 148 are shown as continuous strips, those skilled in the art will recognize that the strips could be formed by a series of individual glue dots if desired. The first and second thin strips of adhesive 184, 186 could also extend from either the first transverse line of weakening or the second transverse line of weakening 146 to a base fold line 190. A series of glue dots 188 are applied along the top 108 of the base sheet 102 to seal the mailer to prevent the fixed and variable information printed on the customer records portion 154 and the returnable portion 152 from being viewed during mailing and yet provide a frangible glue line that is easily ruptured when the mailer is to be opened.

An envelope window 196 is die cut into the base sheet 102 between the base fold line 190 and the first transverse line of weakening 140. The envelope window 196 and the customer's address 166 are placed such that when the base sheet 102 is folded on the base fold line 190, the customer's address 166 can be seen.

The base sheet 102 is then folded upon itself along the base fold line 190 and secured by the first and second thin strips 184, 186, respectively to define a return envelope pocket 200 (FIG. 10). The base fold line 190 is located between the first transverse line of weakening 140 and the second transverse line of weakening 146.

Preferably, the base fold line 190 is located halfway between the first and second transverse lines of weakening 140, 146, respectively.

The base sheet 102 is then folded along an upper fold line 206 located between the top 108 and the first transverse line of weakening 140 and secured by the glue dots 188 and the adhesive 180 on the first and second tear strips 124, 134, respectively. The first and second lines of weakening 120, 130 are then placed in the first and second desired locations 122, 132, respectively if not done previously.

Figure 8:
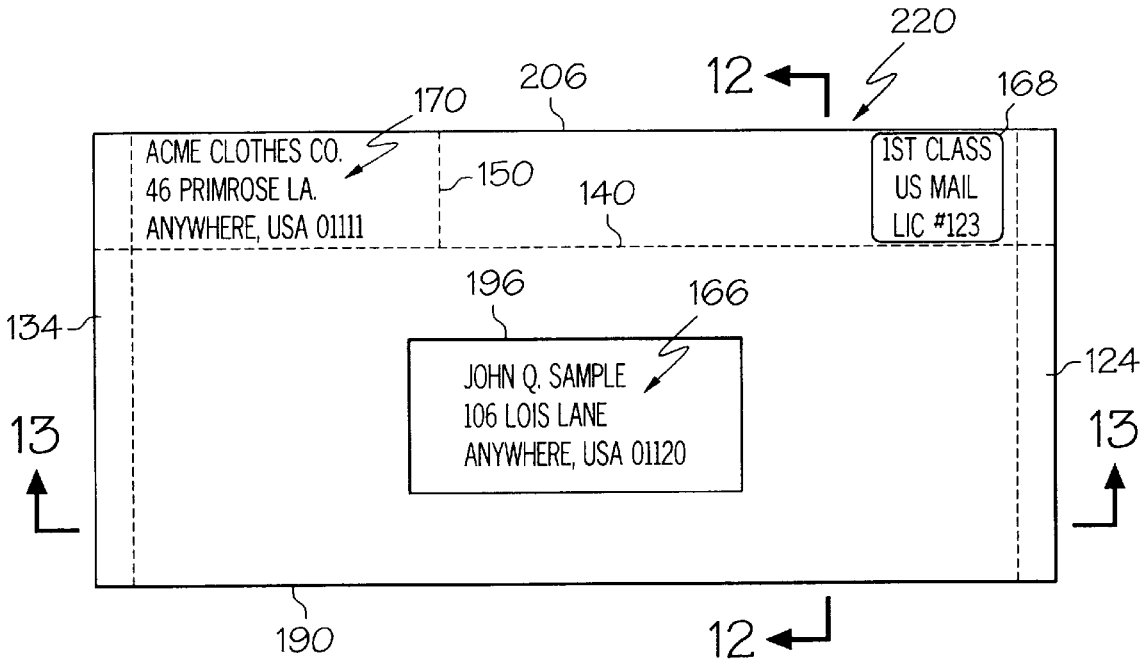
FIG. 8 is a plan view of the alternate business form construction folded and ready to be mailed.
Figure 9:
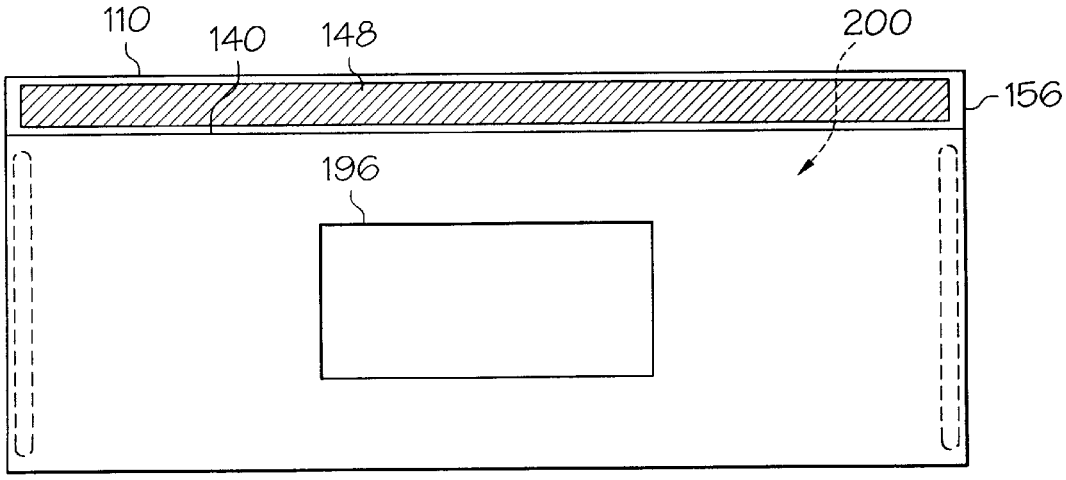
FIG. 9 is a plan view of the alternate business form construction opened and with the removable top portion and first and second tear strips removed.

When a customer receives a folded business form 220 in FIG. 8, the customer removes and discards the first and second tear strips 124, 134, respectively, by tearing along the first and second lines of weakening 120, 130, respectively. The glue line formed by the glue dots 188 is then broken and the mailer opened. The customer then removes a top portion including the returnable portion 152 and the customer records portion 154 by tearing along the first transverse line of weakening 140. The customer then removes a returnable portion 152 from the customer records portion 154 by tearing along the third line of weakening 150 (see FIGS. 10 and 11). The customer can then fill in additional variable information, for example, an amount indicia 226 on the returnable portion 152 and insert the returnable portion 152 in the envelope pocket 200 (FIG. 9) with the return address indicia 230 aligned with the envelope window 196. A check may be enclosed if required.

The customer then moistens the lateral strip of adhesive 148 on the envelope flap 156 and folds the envelope flap 156 to enclose the envelope pocket 200.

As a result of the foregoing, it will be readily appreciated that a cut sheet mailer business form made according to the invention is ideally suited for use in connection with imprintation by non-impact printers, even where a return mailer provision is required. Because the business form may be in the form of a single, unfolded sheet up through the imaging process involving the non-impact printer, feeding problems heretofore encountered with cut sheet mailers having return mailers in non-impact printers are completely avoided. The form may be readily processed on commercially available fold and seal units. For example, a Glue Seal model 4503 fold/seal unit available from the assignee of the instant application or the Glue Fold Company is ideally suited for locating the glue lines 64, 70 and 74; or 180, 184 and 186 on the form after the same has been imaged and before the necessary folding operations. other like advantages provided by the invention will be readily apparent to those skilled in the art.

What is claimed is:

1. A single sheet business form construction printable in an impact or a non-impact printer comprising:

a base sheet of face stock having a front, a back, a top, a bottom, and first and second sides, the base sheet being adapted to receive a first line of weakening in a first desired location extending adjacent and parallel to said first side to define a first tear strip on the base sheet between said first desired location and said first side, and being adapted to receive a second line of weakening in a second desired location extending adjacent and parallel to said second side to define a second tear strip on the base sheet between said second desired location and said second side;

a first transverse line of weakening intermediate and parallel said top and said bottom and extending between said first and second desired locations; and a lateral strip of adhesive parallel to said transverse line of weakening between said transverse line of weakening and said bottom;

the distance between the top of said base sheet and the bottom of said base sheet being about 11 inches, a distance between said first side and said second side being about 8.5 inches, a distance between said top and said first transverse line of weakening being about 3.5 inches, and a distance between a lower edge of said lateral strip of adhesive and said bottom being about 7 inches.

2. A single sheet business form construction printable in an impact or a non-impact printer comprising:

a base sheet of face stock having a front, a back, a top, a bottom, and first and second sides, the base sheet being adapted to receive a first line of weakening in a first desired location extending adjacent and parallel to said first side to define a first tear strip on the base sheet between said first desired location and said first side, and being adapted to receive a second line of weakening in a second desired location extending adjacent and Parallel to said second side to define a second tear strip on the base sheet between said second desired location and said second side;

a first transverse line of weakening intermediate and parallel said top and said bottom and extending between said first and second desired locations; and a lateral strip of adhesive parallel to said transverse line of weakening between said transverse line of weakening and said bottom;

the distance between the top of said base sheet and the bottom of said base sheet being about 14 inches, a distance between said first side and said second side being about 8.5 inches, a distance between said top and said transverse line of weakening being about 4 and ⅞ inches and a distance between a lower edge of said lateral strip of adhesive and said bottom being about 8 inches.

3. A single sheet business form construction printable in an impact or a non-impact printer comprising:

a base sheet of face stock having a front, a back, a top, a bottom, and first and second sides, said base sheet being adapted to receive a first line of weakening in a first desired location extending adjacent and parallel to said first side to define a first tear strip on the base sheet between said first desired location and said first side, said first tear strip having adhesive applied thereto, said base sheet being adapted to receive a second line of weakening in a second desired location extending adjacent and parallel to said second side to define a second tear strip on the base sheet between said second desired location and said second side, said second tear strip having adhesive applied thereto;

a first transverse line of weakening intermediate and parallel said top and said bottom and extending between said first and second desired locations;

a lateral strip of adhesive adjacent and parallel to said first transverse line of weakening between said first transverse line of weakening and said bottom;

a first thin strip of adhesive between said bottom and a lower edge of said lateral strip of adhesive and lying adjacent and parallel to said first desired location between said first and second desired locations; and a second thin strip of adhesive between said bottom and the lower edge of said lateral strip of adhesive and lying adjacent and parallel to said second desired location between said first and second desired locations, wherein said base sheet is folded along a base fold line and secured by said first and second thin strips of adhesive and said adhesive on said first and second tear strips to define an envelope pocket, said base fold line being located between the lower edge of said lateral strip of adhesive and said bottom.

4. The business form construction of claim 3 wherein said base sheet is folded upon itself between said base fold line and said top and adhered to itself at leastby said adhesive on said first and second tear strips of glue.

5. The business form construction of claim 3 wherein said base fold line is located about halfway between said lower edge and said bottom.

6. The business form construction of claim 3 further including the first and second lines of weakening.

7. The business form construction of claim 3 wherein the lateral strip of adhesive is remoistenable glue.

8. The business form construction of claim 3 wherein information is printed on the front side of the base sheet between said transverse line of weakening and said top.

9. The business form construction of claim 3 wherein a distance between the top of said base sheet and the bottom of said base sheet is about 11 inches, a distance between said first side and said second side is about 8.5 inches, a distance between said top and said transverse line of weakening is about 3.5 inches, and a distance between the lower edge of said lateral strip and said bottom is about 7 inches.

10. The business form construction of claim 6 wherein the first, second, and transverse lines of weakening are perforation lines.

11. The business form construction of claim 3 wherein a distance between the top of said base sheet and the bottom of said base sheet is about 14 inches, a distance between said first side and said second side is about 8.5 inches, a distance between said top and said transverse line of weakening is about 4 and ⅞ inches and a distance between a lower edge of said lateral strip of adhesive and said bottom is about 8 inches.

12. A single sheet business form construction printable in an impact or a non-impact printer comprising:

a base sheet of face stock having a front, a back, a top, a bottom, and first and second sides, said base sheet being adapted to receive a first line of weakening in a first desired location extending adjacent and parallel to said first side to define a first tear strip on the base sheet between said first desired location and said first side, said first tear strip having adhesive applied thereto, said base sheet being adapted to receive a second line of weakening in a second desired location extending adjacent and parallel to said second side to define a second tear strip on the base sheet between said second desired location and said second side, said second tear strip having adhesive applied thereto;

a first transverse line of weakening intermediate and parallel said top and said bottom and extending between said first and second desired locations;

a second transverse line of weakening located adjacent and parallel said bottom and extending between said first and second desired locations to define an envelope flap between said second transverse line of weakening and said bottom;

a third line of weakening parallel to said first and second desired locations and extending between said top and said first transverse line of weakening;

a lateral strip of adhesive adjacent and parallel to said second transverse line of weakening between said second transverse line of weakening and said bottom;

a first thin strip of adhesive between said first and second transverse lines of weakening and lying adjacent and parallel to said first desired location between said first and second desired locations; and a second thin strip of adhesive between said first and second transverse lines of weakening and lying adjacent and parallel to said second desired location between said first and second desired locations, wherein said base sheet is folded along a base fold line and secured by said first and second thin strips of adhesive and said adhesive on said first and second tear strips to define an envelope pocket, said base fold line being located between the first and second transverse lines of weakening.

13. The business form construction of claim 12 wherein said base sheet is folded upon itself at an upper fold line located between said first transverse line of weakening and said top and adhered to itself at least by said adhesive on said first and second tear strips of glue.

14. The business form construction of claim 12 wherein said base fold line is located about halfway between said first and second transverse lines of weakening.

15. The business form construction of claim 12 further including the first and second lines of weakening.

16. The business form construction of claim 12 wherein the lateral strip of adhesive is remoistenable glue.

17. The business form construction of claim 12 wherein information is printed on the front side of the base sheet between said first transverse line of weakening and said top.

18. The business form construction of claim 15 wherein the first, the second, and the third lines of weakening and the first and second transverse lines of weakening are perforation lines.

* * * * *

UNITED STATES PATENT AND TRADEMARK OFFICE

CERTIFICATE OF CORRECTION

PATENT NO : 6,129,389

DATED : October 10, 2000

INVENTOR(S) : Zo Younger

It is certified that error appears in the above-identified patent and that said Letters Patent are hereby corrected as shown below:

Col. 11 Line 26 "itself at leastby said" Should read ---itself at least by said---

Signed and Sealed this

Twenty-second Day of May, 2001

*Attest:*

Nicholas P. Godici

NICHOLAS P. GODICI

*Attesting Officer*

*Acting Director of the United States Patent and Trademark Office*